United States Patent [19]

Yurko

[11] Patent Number: 4,721,226

[45] Date of Patent: Jan. 26, 1988

[54] WASTE CONTAINER-BAG DISPENSER COMBINATION

[76] Inventor: Edward P. Yurko, 5987 McKinley St., Merrillville, Ind. 46410

[21] Appl. No.: 906,324

[22] Filed: Nov. 10, 1986

Related U.S. Application Data

[63] Continuation of Ser. No. 660,309, Nov. 12, 1984, abandoned.

[51] Int. Cl.[4] ..... B65D 25/16

[52] U.S. Cl. ..... 220/407; 220/1 T

[58] Field of Search ..... 220/407, 404, 403, 1 T, 220/470

[56] References Cited

U.S. PATENT DOCUMENTS

| | | | |
|---|---|---|---|
| 2,916,183 | 12/1959 | Ariens | 220/407 X |
| 3,300,082 | 1/1967 | Patterson | 220/407 X |
| 3,392,825 | 7/1968 | Gale et al. | 220/404 |
| 3,451,453 | 6/1969 | Heck | 220/407 |
| 3,760,975 | 9/1973 | Nilsson | 220/407 |
| 3,800,503 | 4/1974 | Maki | 220/407 |
| 4,319,694 | 3/1982 | Nehrbass et al. | 220/407 |
| 4,349,123 | 9/1982 | Yang | 220/407 |

*Primary Examiner*—Steven M. Pollard

*Attorney, Agent, or Firm*—Richard G. Kinney

[57] ABSTRACT

This invention is a waste container structured to receive and retain a commercially distributable bag dispenser box from a side opening in the bottom of the container. The bag dispenser box that is contemplated to be used in combination with this waste container is rectangular in shape and contains a plurality of flatly folded bags, each of which are retrievable from a top slot. When in position in the waste container, the bag dispenser box is prevented from being lifted as each bag is pulled from the box by inwardly extending projections provided on the inside wall of the waste container.

6 Claims, 4 Drawing Figures

WASTE CONTAINER-BAG DISPENSER COMBINATION

This is a continuation of application Ser. No. 660,309, filed Nov. 12, 1984, now abandoned.

BACKGROUND OF THE INVENTION

1. Field of the Invention

This invention relates to waste containers and more particularly to waste containers structured to receive and retain a bag dispenser box.

2. Discription of the Prior Art

The prior art waste containers generally used are hollow receptacles for receiving and storing refuse which when filled are emptied. The refuse is collected and discarded and the empty waste container is positioned for reuse. For convenience in discarding the refuse from the container, plastic or paper bags are inserted in the container and inflated or opened to loosely line the sides of the container. Refuse is then collected in the paper or plastic bag, and when filled, one merely has to remove the bag insert and discard the filled bag leaving the interior of the container not only empty for reuse but also clean since some of the refuse generally includes wet and adhering material.

Some of the prior art improved waste containers that I am aware of do include in combination therewith bag dispensers. However, these bag dispensers are the roll type which require means for supporting a roll on bearing mounts so the roll will be free to rotate in order to dispense a bag to line the container. Such structural requirements would require the size of the roll of bags to have a correspondence with the size of the container.

SUMMARY OF THE INVENTION

This invention is a waste container structured to receive and retain a commercially distributable bag dispenser box from a side opening in the bottom of the container. Accordingly, the only object that needs to be handled is the bag dispenser box. This invention does not include any other element or member necessary to accommodate the bag dispensing box to the waste container. The principal advantage of this invention is the provision of a waste container having a simple design being economical to manufacture and which, without additional elements, can receive and retain a generally uniform commercially available bag dispensing box. Such a commercially available bag dispensing box is disposable when the contents are used and the waste container is supplied with a new box. Another advantage is that the novel structural elements necessary to accommodate the bag dispensing box may be incorporated in any size or shape waste container thereby allowing uniformity of bag dispensing boxes which enhances the economy of commercially available bag dispensing boxes. This encourages more widespread use of such bag dispensing boxes in combination with waste containers.

Other objects and advantages of this invention will become more apparent after a more careful study of the following detailed description taken with reference to the accompanying drawings wherein a preferred embodiment is illustrated.

DETAILED DESCIPTION OF THE INVENTION

Figure 1:
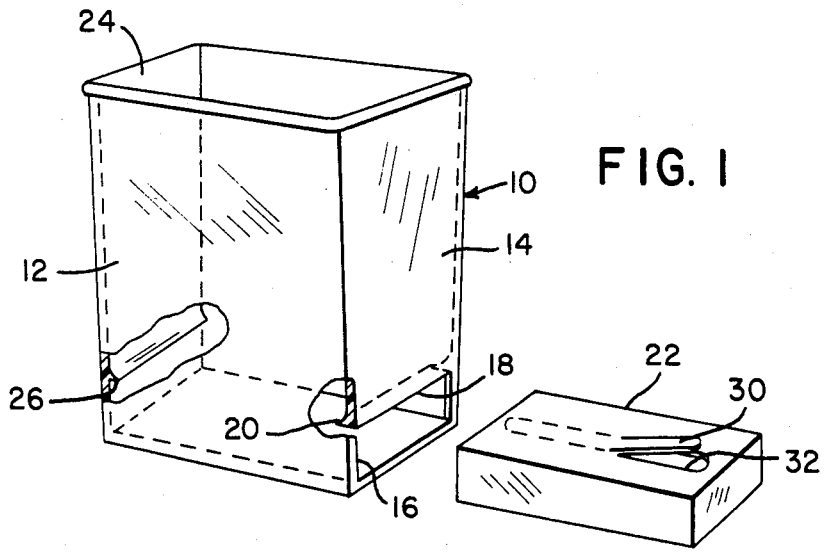
FIG. 1 is a perspective view of a generally rectangular waste container of my invention, portions thereof being broken away to show the inwardly extending projections for retaining a bag dispensing box shown positioned for insertion in the waste container.

Referring now more particularly to the drawings wherein is illustrated a preferred embodiment of this invention, reference numeral 10 designates generally the waste container of this invention. It comprises a container body 12, generally rectangular in shape when viewed from the front, side and top, each side being slightly diverging from the bottom to top. I provide in one of the sides, such as side 14, a rectangular opening 16 adjacent the bottom of the container. Top horizontal edge 18 of opening 16 is bent or molded to provide an inwardly extending part 20 which serves as part of a box retainer stop for the inserted box 22. The opposite side 24 is provided with a horizontally positioned, inwardly extending projection 26 spaced from the bottom of the container. Both projections 20 and 26 serve as stops to retain box 22 on the bottom of the container.

Acting in cooperation with container 10 of my invention is bag dispensing box 22 which is rectangular in shape and constructed generally on the order of a Kleenex box. I contemplate such boxes being filled with flat folded plastic or paper bags 28, the bottom ends being interfolded with the top ends of the succeeding bags. Bag dispensing boxes 22 containing bags 28 are preferably made of cardboard having a perforated outline on top of each box longitudinally thereacross. These boxes containing the above described waste bags can be made commercially available and dimensioned to be slipped in endwise in opening 16 of container 10. Opposing box retainer projections 20 and 26 serve to prevent the box from being pulled upwardly when bags 28 are individually pulled therefrom. When box 22 is in place and with the perforated cover strip 30 torn off exposing a slotted opening 32, the top end of the first bag is exposed to be pulled up and inflated to line the container with the waste bag which is seated on top of box 22 ready to receive the refuse.

When bag 28 becomes full, the user merely removes the filled bag from container 10 and discards the bag. In the process of removing bag 28 from box 22, the top end of the succeeding bag in box 22, being interfolded with the bottom closed end of the preceding bag, will exit slotted opening 32 of box 22 and is available for grasping by the user who merely lifts the bag and opens it to again line waste container 12.

Figure 2:
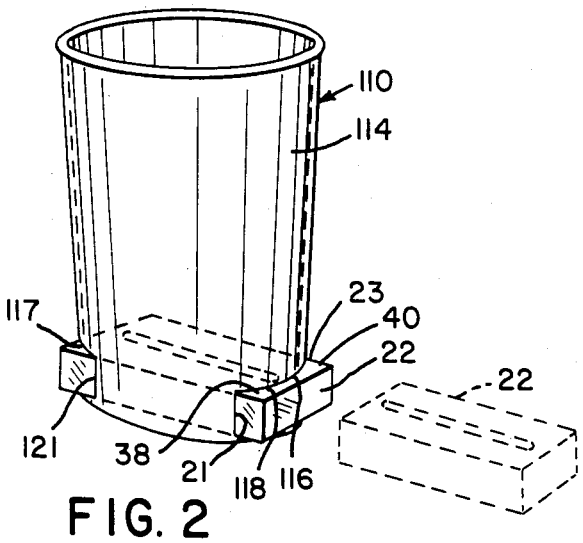
FIG. 2 is a perspective view of a generally circular waste container of my invention shown in combination with a bag dispensing box inserted in the opening of the container.
Figure 3:
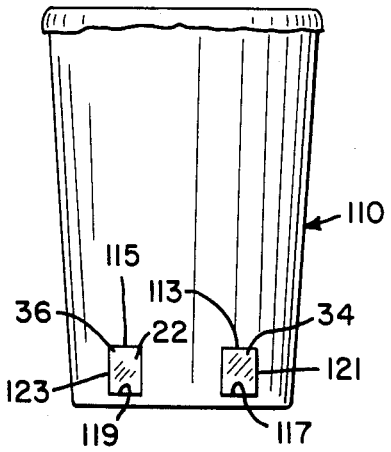
FIG. 3 is a side view opposite the opening of the container through which the bag dispensing box is inserted.
Figure 4:
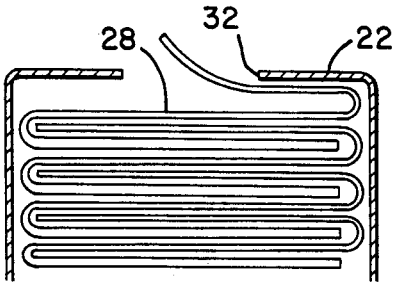
FIG. 4 is a cross sectional view of a bag dispensing box showing the interlocking folds of a plurality of waste bags packaged in the box so that when the top bag is removed, the top part of the succeeding bag is pulled through the top opening of the box.

My invention can be applied not only to the rectangularly shaped waste container which I have described above, but also to circular or cylindrically shaped container 110. Such waste container 110 is shown in FIGS. 2 and 3. For such circularly shaped container, I similarly provide a rectangular opening 116 in circularly curved side wall 114 adjacent the bottom thereof. Diametrically opposite opening 116, I preferably provide two rectangular openings 117 and 119 angularly spaced apart. Parts of openings 117 and 119 are aligned with corresponding parts of opening 116, that is, outer edges 121 and 123 of openings 117 and 119 respectively are aligned with vertical edges 21 and 23 of rectangular opening 116. In circular or cylindrically shaped container 110 such as shown in FIGS. 2 and 3 there will be no need to provide inwardly extending projections to serve as stops. Since the circular side wall 114 of container 110 is curved, the top edges 113 and 115 of spaced openings 117 and 119 respectively, and top edge 118 of opening 116 are positioned diagonally over and thereby retain protruding corners 34, 36, 38, and 40, respectively, of rectangular bag dispensing box 22 inserted through opening 116 in cylindrical container 110. The bag dispensing operation is the same as described for the rectangular waste container.

It is obvious from the above description that waste containers of different shapes and sizes may be economically provided to cooperate with a uniformly shaped, commercially available disposable box from which waste bags may be dispensed as needed. The novel structure of my invention not only is economical to incorporate as a structural modification in the manufacture of waste containers, but also, whether rectangular or circular in structure, may receive a uniformly shaped bag dispenser box which may be commercially available without regard to the manufacturing source of the waste container.

I claim:

1. The combination of a waste container comprising a unitary structure including a base and upright side walls defining upwardly an open volume, one of the said side walls having an opening into the open volume adjacent the base, a projection on said one side wall adjacent the top edge of said opening extending inwardly in said container and being spaced from the base of said container, a projection on another side wall of said container extending inwardly in said container, said projection being spaced from said base and being aligned with said inwardly extending projection adjacent said opening; and a bag dispensing box containing a plurality of bags positioned on said base in said container, filling part of said open volume, said box being sized to fit within said opening and to extend between said opening and said other side wall and be retained on said base of said container by said inwardly extending projections provided on said side walls of said container and said box being otherwise exposed to said open volume, whereby said box may be easily placed by being slid into said opening.

2. A waste container for retaining a disposable bag dispensing box comprising a unitary structure which includes a base and a curvelinear upright side wall which together define a volume which opens upward;

a part of said curvelinear side wall having a rectangular opening into the volume adjacent the base;

a second part of said side wall having spaced rectangular openings into the volume, said spaced openings in said second part of said side wall being opposite from said first mentioned opening, end parts of said opening in said first part of said side wall being aligned with corresponding end parts of said spaced openings, and the top edge of each of said openings being curvelinear, whereby the box may be slid into the bottom of the volume defined by the unitary structure and project out of said openings so that the top edge of said openings will hold the box against being pulled upward when a disposable bag is pulled upward from the box.

3. A waste container for retaining a bag dispenser box comprising a base and upright side walls, defining an unpwardly opening volume, one of the side walls having an opening into the open volume adjacent the base, first stop member means on said side wall adjacent the top edge of said opening extending inwardly in said container and being spaced from the base of said container; and second stop member means on another side wall of said container extending inwardly in said container, said second stop member means being spaced from said base and being aligned with said inwardly extending first stop member on said one of said side walls, whereby the bag dispensing box may be received through said opening into the bottom of said volume and held therein by said stop member means against upward movement when a bag is pulled from the box.

4. The waste container of claim 3 wherein said stop members are further characterized as being projections formed on said side walls.

5. The combination of a waste container comprising a structure defining base and a curvelinear upright side wall which together define an upwardly opening volume, a part of said curvelinear side wall having a rectangular opening adjacent the base, a second part of said side wall having a rectangular opening adjacent the base, said opening in said second part of said side wall being opposite from said first mentioned opening, end parts of said first mentioned opening being aligned with corresponding end parts of said opening in said second part of said side wall, and the top edge of said openings being curvelinear; and a bag dispensing box comprising a rectangularly shaped disposable container containing a plurality of folded bags positioned on said base through said opening in said first a part of said side wall of said waste container, said rectangular box being retained on said base of said container by said top curvelinear edges of said openings.

6. The combination of a waste container and a flat, rectilinear disposable bag dispensing box, having a top with marginal portions and an opening in said box top through which disposable bags may be pulled, said container comprising a structure which includes a base and upright side wall means connected to said base, which base and wall means together define a volume which opens upward;

said wall means defining a generally rectilinear side opening being shaped and sized to conform to and receive the disposable dispensing box and to allow it to slide, while flat, into the bottom portion of said volume just above said base;

first stop means formed at said wall means opposite said rectilinear opening for contacting a portion of the marginal top surface of said box and restraining that surface of said box from directly-upward movement when it has been so positioned in said volume;

second stop means formed by said side wall means at said rectilinear opening for contacting and restraining the marginal surface of the top of the disposable box from upward movement after it has been positioned in said volume, said box being positioned in said volume above said base so that it spans between said opening and the opposite upstanding wall with said first and second stop means contacting respectively opposite marginal portions of said top of said box without interfering with or covering said box opening, whereby the box may be slid into the bottom of said volume defined by said base and held there by said stop means against being pulled upward while a disposable bag is pulled upward from its top opening.

* * * * *